US005428265A

United States Patent [19]

Booth, Jr. et al.

[11] Patent Number: 5,428,265

[45] Date of Patent: Jun. 27, 1995

[54] PROCESSOR CONTROLLED FLUORESCENT LAMP DIMMER FOR AIRCRAFT LIQUID CRYSTAL DISPLAY INSTRUMENTS

[75] Inventors: Lawrence A. Booth, Jr., Phoenix, Ariz.; David W. Luz; Robert J. Vitello, both of Albuquerque, N. Mex.; Roger E. Wiegel, Rio Rancho, N. Mex.

[73] Assignee: Honeywell, Inc., Minneapolis, Minn.

[21] Appl. No.: 202,322

[22] Filed: Feb. 28, 1994

[51] Int. Cl.[6] ..... H05B 37/02

[52] U.S. Cl. ..... 315/158; 315/149; 315/308; 315/150; 315/154; 315/DIG. 4

[58] Field of Search ..... 315/158, 149, 307, 308, 315/DIG. 4, 150, 154

[56] References Cited

U.S. PATENT DOCUMENTS

| | | | |
|---|---|---|---|
| Re. 31,146 | 2/1983 | Gyursanszky | 315/276 |
| 4,127,798 | 11/1978 | Anderson | 315/209 |
| 4,168,453 | 9/1979 | Gerhard et al. | 315/225 |
| 4,350,933 | 9/1982 | Agarwala et al. | 315/278 |
| 4,353,009 | 10/1982 | Knoll | 315/220 |
| 4,370,600 | 1/1983 | Zansky | 315/244 |
| 4,392,087 | 7/1983 | Zansky | 315/219 |
| 4,396,872 | 8/1983 | Nutter | 315/308 |
| 4,408,270 | 10/1983 | Anderson et al. | 363/132 |
| 4,516,055 | 5/1985 | Nelson | 315/151 |
| 4,523,128 | 6/1985 | Stamm et al. | 315/291 |
| 4,523,131 | 6/1985 | Zansky | 315/307 |
| 4,568,857 | 2/1986 | Head | 315/105 |
| 4,612,479 | 9/1986 | Zansky | 315/194 |
| 4,658,343 | 4/1987 | Shepard, Jr. | 363/22 |
| 4,682,084 | 7/1987 | Kuhnel et al. | 315/307 |
| 4,704,563 | 11/1987 | Hussey | 315/307 |
| 4,717,863 | 1/1988 | Zeiler | 315/307 |
| 4,868,459 | 9/1989 | Dennerlein et al. | 315/158 |
| 4,899,088 | 2/1990 | Black, Jr. et al. | 315/291 |
| 4,904,906 | 2/1990 | Atherton et al. | 315/291 |
| 4,937,504 | 6/1990 | Black, Jr. et al. | 315/307 |
| 4,939,423 | 7/1990 | Ruby | 315/105 |
| 4,947,079 | 8/1990 | Black, Jr. et al. | 315/205 |
| 4,998,045 | 3/1991 | Ruby | 315/209 |
| 4,998,046 | 3/1991 | Lester | 315/209 |
| 5,004,972 | 4/1991 | Roth | 323/320 |
| 5,027,034 | 6/1991 | Ruby et al. | 315/106 |
| 5,055,746 | 10/1991 | Hu et al. | 315/291 |
| 5,068,576 | 11/1991 | Hu et al. | 315/291 |
| 5,089,925 | 2/1992 | Lester | 361/84 |
| 5,105,127 | 4/1992 | Lavaud et al. | 315/291 |
| 5,107,184 | 4/1992 | Hu et al. | 315/291 |
| 5,204,587 | 4/1993 | Mortimer et al. | 315/308 |
| 5,272,327 | 12/1993 | Mitchell | 315/158 |
| 5,336,976 | 8/1994 | Webb et al. | 315/158 |
| 5,336,978 | 8/1994 | Alessio | 315/158 |

*Primary Examiner*—Robert J. Pascal
*Assistant Examiner*—Reginald A. Ratliff
*Attorney, Agent, or Firm*—Kenneth J. Johnson

[57] ABSTRACT

A processor controlled fluorescent lamp dimmer circuit is shown for use in an aircraft display system utilizing a fluorescent lamp in the backlight system of individual LCD display devices. By use of a processor control dimming circuit in control over each LCD display, greater flexibility, e.g., as by adjustment in software parameters, is made possible in the operation of a dimmer control circuit. The dimmer control circuit reacts to such conditions as ambient light within the aircraft cockpit, fluorescent lamp light energy output, and fluorescent lamp temperature to provide substantially consistent actual and perceived luminance on the LCD display as a function of such detected conditions. Furthermore, the processor control achieves the desired luminance without over-driving, and therefore deteriorating, the lamps. As a result, the pilot of the aircraft enjoys a more reliable and consistent LCD display and need not be distracted by variation in luminance of the LCD display in operation of the aircraft.

6 Claims, 5 Drawing Sheets

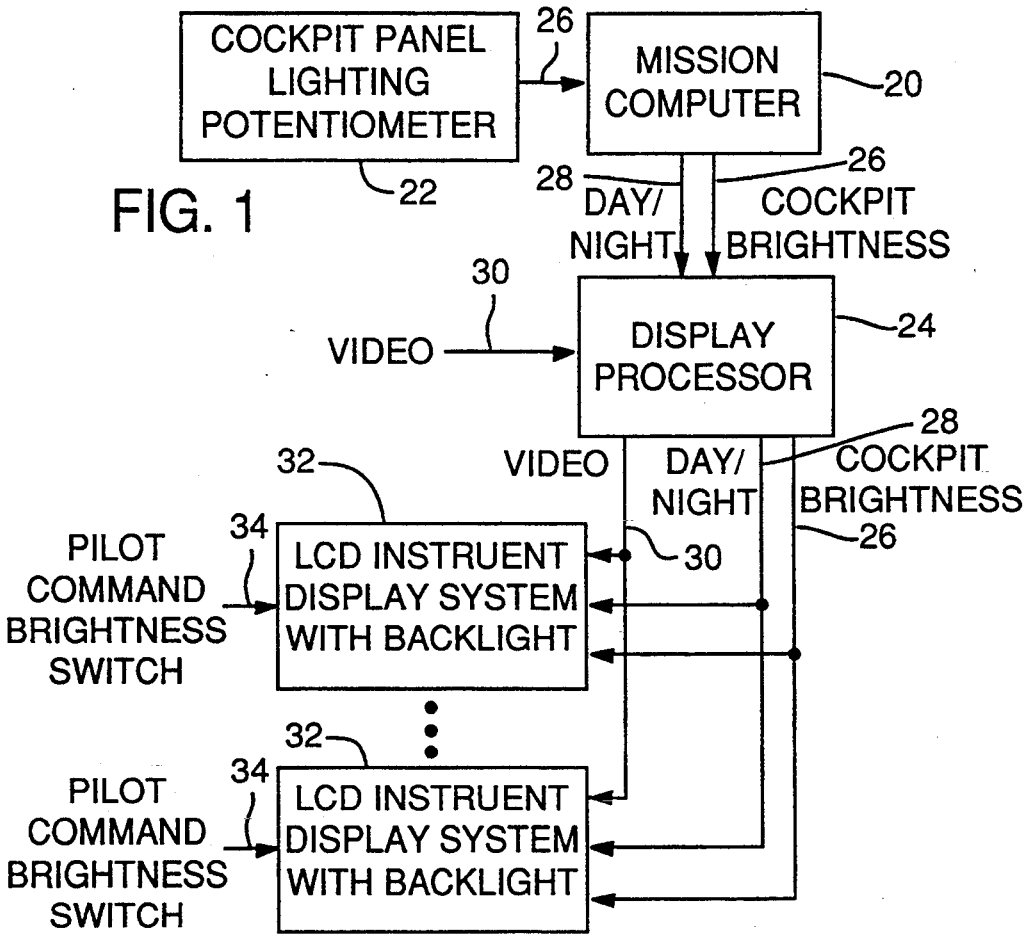
FIG. 1
FIG. 3A
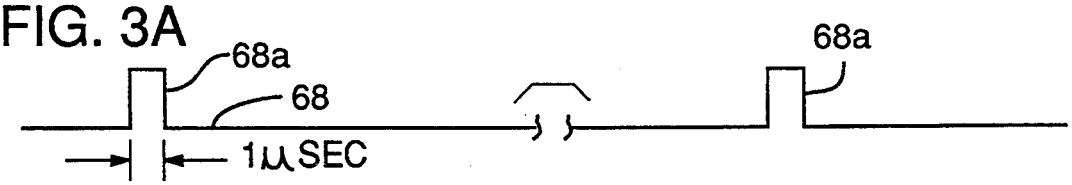
FIG. 3B
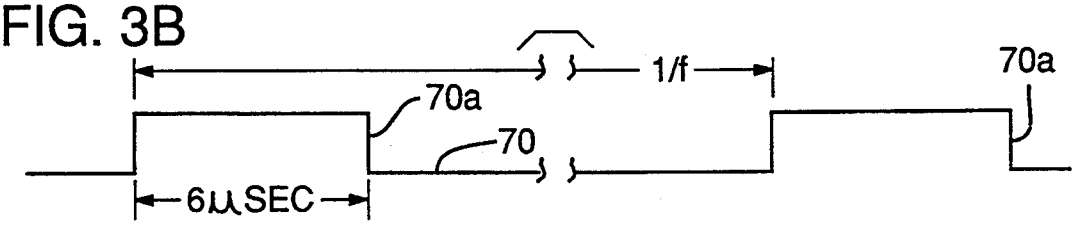
FIG. 3C
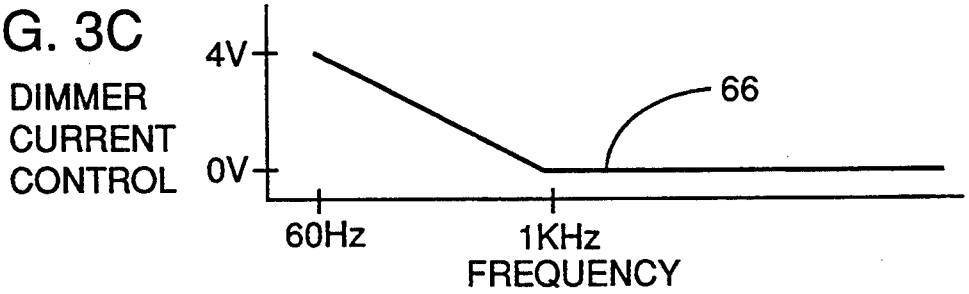

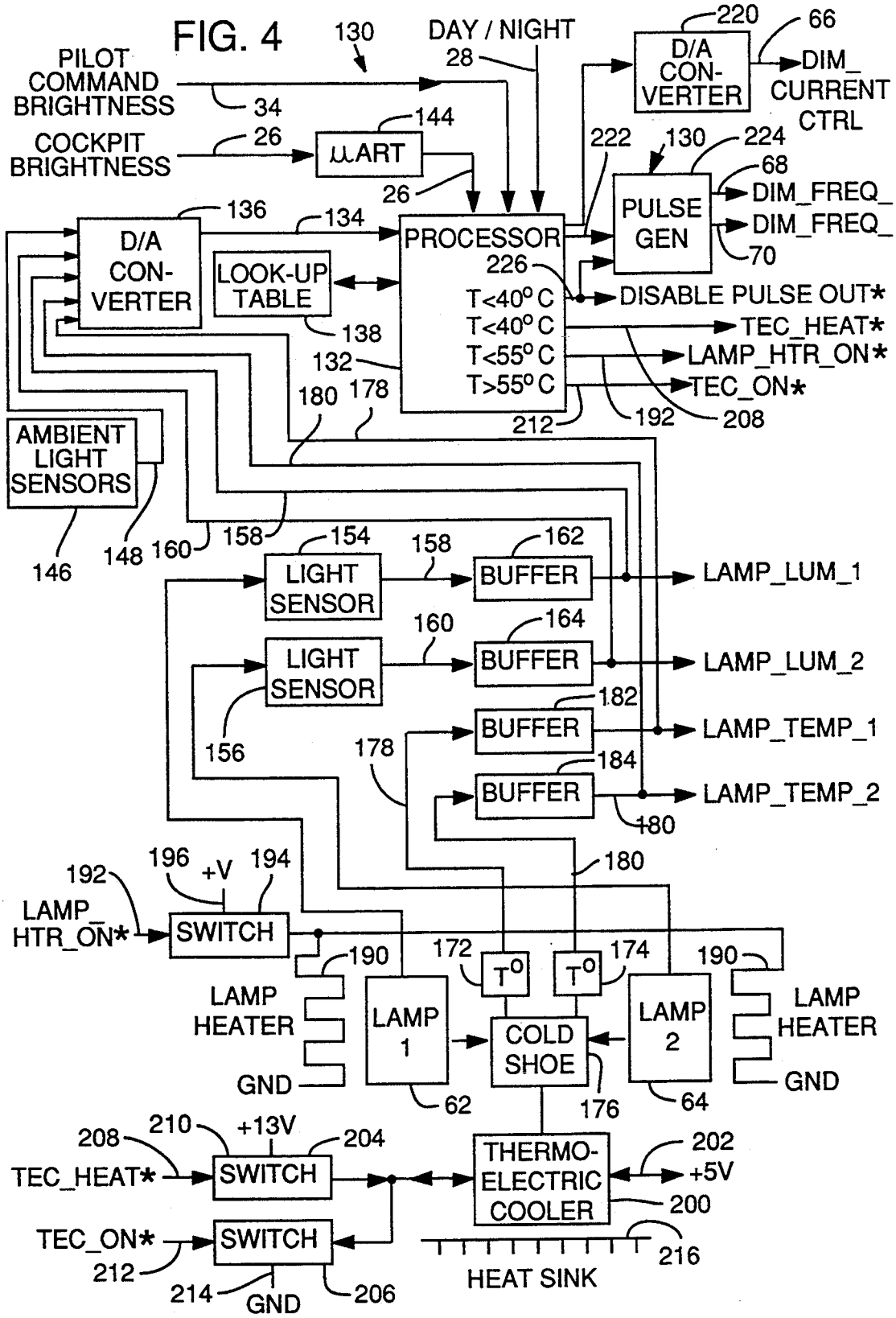
FIG. 4
130
DAY / NIGHT
28
PILOT COMMAND BRIGHTNESS
34
COCKPIT BRIGHTNESS
26
µART
144
26
D/A CON-VERTER
220
66
DIM_ CURRENT CTRL
222
130
224
68
PULSE GEN
DIM_FREQ_
DIM_FREQ_
70
136
134
D/A CON-VERTER
PROCESSOR
226
LOOK-UP TABLE
138
132
T<40° C
T<40° C
T<55° C
T>55° C
DISABLE PULSE OUT*
TEC_HEAT*
LAMP_HTR_ON*
TEC_ON*
212
192
208
180
178
AMBIENT LIGHT SENSORS
146
148
160
158
154
158
162
LIGHT SENSOR
BUFFER
LAMP_LUM_1
160
164
LIGHT SENSOR
BUFFER
LAMP_LUM_2
156
182
BUFFER
LAMP_TEMP_1
178
184
BUFFER
LAMP_TEMP_2
180
180
192
196
+V
194
LAMP_ HTR_ON*
SWITCH
190
172
174
190
LAMP HEATER
LAMP 1
COLD SHOE
LAMP 2
LAMP HEATER
GND
62
176
64
GND
208
210
+13V
204
TEC_HEAT*
SWITCH
THERMO-ELECTRIC COOLER
202
+5V
200
TEC_ON*
SWITCH
212
214
GND
206
HEAT SINK
216

PROCESSOR CONTROLLED FLUORESCENT LAMP DIMMER FOR AIRCRAFT LIQUID CRYSTAL DISPLAY INSTRUMENTS

BACKGROUND OF THE INVENTION

The present invention relates generally to fluorescent lamp control devices, and particularly to a dimmer control function in a fluorescent lamp used in a liquid crystal display (LCD) device of an aircraft instrument display system.

LCD panels are now used widely in many aircraft instrument display systems. An LCD device includes a liquid crystal panel selectively made opaque in certain regions in order to generate images, icons and characters in an instrument display in response to, for example, a video signal. To further enhance the visibility of such images of the liquid crystal panel, LCD devices require a backlight, i.e., a light source positioned on the backside of the liquid crystal panel. As applied to aircraft instrument display systems, especially in military aircraft display systems, it is important that the LCD device maintain a substantially constant display luminance. As may be appreciated, the pilot of such an aircraft is better able to observe LCD presentations with constant luminance. Variation in LCD luminance can be distracting to a pilot operating the aircraft, especially a fighter aircraft engaged in combat maneuvers. Accordingly, it will be understood that the maintenance of constant luminance in an aircraft display system is not only a desirable characteristic, it can be vitally important when the pilot makes split-second decisions based on information obtained from the LCD instrument display system.

Various factors can affect both the perceived and actual luminance of an LCD instrument display. For example, temperature variations can affect the light output of a fluorescent lamp, and, therefore, the actual luminance of an LCD device using a fluorescent lamp as the backlight device. Variations in ambient light conditions affect the perceived luminance of an LCD device. An aircraft instrument display system should provide substantially constant perceived luminance through a range of bright daylight to extreme darkness. Bright daylight conditions require a relatively greater actual light output to maintain a given apparent luminance of the LCD display device. For extreme darkness, a relatively lesser light output is required to maintain constant the perceived luminance of the LCD device. For temperature variations, extreme high or low temperature conditions, i.e., relative to a most efficient temperature condition for a given lamp, require greater energy input to the fluorescent lamp in order to maintain a given LCD luminance. As may be appreciated, the requirements for aircraft, especially military aircraft, are stringent. The temperature and ambient light conditions through which constant perceived and actual luminance are required are broad.

Previous aircraft display systems directed toward relatively constant LCD display device luminance have used dedicated circuitry in the control of light energy output from the fluorescent lamp of the LCD device. For example, various potentiometers and dedicated analog circuitry have been used in conjunction with frequency generators in order to provide dimming functions of fluorescent lamps. Voltage divide circuits have been used to establish temperature set points in the operation of the dimmer circuits as a function of ambient temperature.

The pilot typically controls the brightness of an instrument display by adjusting a potentiometer either on the particular display itself or somewhere on the cockpit instrument panel. Since the eye of the pilot perceives luminance logarithmically in response to linear brightness changes, elaborate analog circuitry has been used to make the perceived logarithmic change in display brightness more uniform in relation to linear potentiometer rotation. Thus, some transformation function is required between the system input provided by the pilot, e.g., operation of a potentiometer, and the operation of the LCD device. In prior fluorescent lamp dimming circuits this transformation function was inflexible as embodied in dedicated circuitry. If, for example, a change in this transformation function was desired, e.g., by preference of a given aircraft purchaser or particular unexpected system configuration, significant design and manufacture changes in the dedicated dimming control circuitry were required.

According to another aspect of fluorescent lamp dimming circuitry, it is important that the dimming circuit not over-drive the fluorescent lamp and thereby deteriorate the lamp. Aircraft display instruments must be as reliable as is possible. Each lamp is desirably operated in an optimum fashion which provides a required display luminance while not over-driving, and therefore deteriorating, the fluorescent lamp. In prior dedicated fluorescent lamp dimming circuits, it has been difficult to design a simple dedicated fluorescent lamp dimming circuit which delivers the required display luminance while not over-driving the fluorescent lamp. Significant complexity in such dedicated dimming circuitry is required to achieve these design goals. Accordingly, prior fluorescent lamp dimming circuits have necessarily traded display luminance control for the reliability, i.e., life expectancy, of the fluorescent lamp.

The present invention provides a fluorescent lamp dimming control function addressing these shortcomings of the prior dimming systems and is well suited for use in aircraft display systems for improved overall pilot operation.

SUMMARY OF THE INVENTION

A preferred embodiment of the present invention comprises a processor control circuit which receives by way of sensor input various conditions related to operation of fluorescent lamps in an LCD instrument display and provides output signals for suitably driving the fluorescent lamps in such manner to maintain a given luminance of the backlight system while not over-driving or deteriorating the lamp. The present invention further provides great flexibility in adjusting the operation of the backlight system, a flexibility not found in prior dimming control devices for LCD backlight systems. In accordance with the preferred embodiment of the present invention, a processor control circuit monitoring such conditions as ambient light and lamp temperature utilizes a lookup table to determine the necessary output to suitably drive the fluorescent lamp of the LCD backlight system in order to maintain a given apparent luminance level and avoid over-driving of the fluorescent backlight system.

With a processor controlled dimmer in accordance with the present invention prior elaborate analog circuitry is eliminated as the method of transforming potentiometer rotation to luminance changes in a display.

Under the control of a processor, brightness of a display can be a simple mathematic calculation or lookup table without a need for elaborate dedicated analog circuitry. Also, if a different transformation function between potentiometer operation and backlight lamp operation is desired, it is easily implemented by simple changes in the software executed by the processor or by a configuration menu choice operation. Thus, control functions such as feedback from light sensors may have special transformation functions to eliminate the effect of non-linear responses. The display may thereby be tailored to a specific application or customer preference without requiring hardware changes. In addition, the pilot-operated dimming potentiometer may be eliminated altogether and replaced with a slew switch, e.g., an up/down rocker switch. Under the present invention, therefore, special transfer functions are far more easily implemented than that of the prior dedicated analog circuitry.

The subject matter of the present invention is particularly pointed and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which:

FIG. 1 is a block diagram of an aircraft control system including use of the present invention in association with the individual control of fluorescent backlights in a set of aircraft LCD instrument devices.

FIGS. 3A–3C illustrate three signals, respectively, applied to the power delivery circuit of FIG. 2.

FIG. 4 is a block diagram of a fluorescent lamp dimmer control circuit according to the preferred embodiment of the present invention, in driving relation to the circuit of FIG. 2 and including a processor as a central control feature.

DETAILED DESCRIPTION OF THE PREFERRED EMBODIMENT

Figure 2:
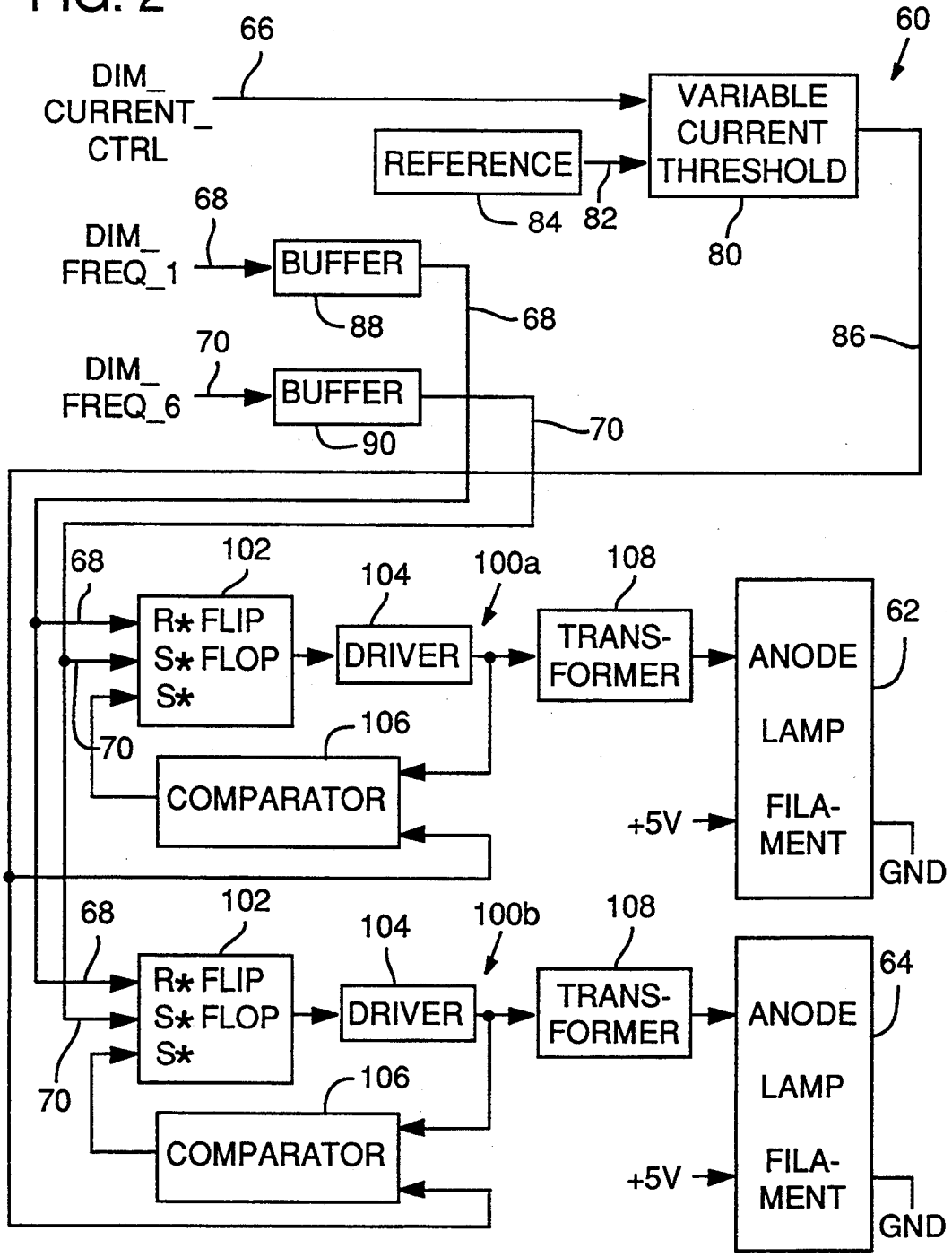
FIG. 2 illustrates a fluorescent lamp dimmer power delivery circuit as used in the preferred embodiment of the present invention.

FIG. 1 illustrates generally an aircraft control system environment in which the dimmer control circuitry of the present invention is incorporated. In FIG. 1, the mission computer 20 is the main processor for aircraft control functions. A pilot-operated cockpit panel lighting potentiometer 22 provides a cockpit brightness signal 26 as an input to mission computer 20 representing an overall instrument display luminance control. Thus, the potentiometer 22 is a global control for determining the overall brightness of all instruments of the aircraft. A display processor 24 receives from mission computer 20 the cockpit brightness signal 26, and also a day/night signal 28. The cockpit brightness signal 26 corresponds to the current position of the cockpit panel lighting potentiometer 22. The day/night signal is a bi-state signal representing the current ambient lighting conditions as selected by pilot control panel operation, e.g., by flipping a day/night switch (not shown). Display processor 24 further receives a video signal 30 for presentation of information on a plurality of LCD instrument display systems 32, each including a fluorescent backlight and dedicated processor control in accordance with the present invention. Display processor 24 delivers the video signal 30 or a suitable portion thereof, day/night signal 28, and cockpit brightness signal 26 to each of the LCD instrument display systems 32. Thus, the instrument system illustrated in FIG. 1 includes a number of individual display systems 32, of which only two are illustrated in FIG. 1, each having a dedicated display function and responsive to an appropriate video signal.

The subject matter of the present invention concerns the use of such multiple display systems 32, each with its own dedicated processor and sensor feedback control (FIG. 4), for improved operation and reliability. The following discussion will describe an individual LCD instrument display system 32, but it will be understood that this description applies to each of the display systems 32 employed in the aircraft display system generally.

Each LCD instrument display system 32 includes circuitry for delivering the video signal 30 to the LCD panel of the LCD instrument display system 32. Further discussion of the application of video signal 30 to the LCD instrument display system 32 will not be discussed herein, but is according to conventional practice.

Each LCD instrument display system 32 includes, as relevant to the present invention, two primary components. First, a power delivery circuit (FIG. 2) for driving fluorescent lamps used as the backlight for the LCD instrument display system 32. Second, a dimming control circuit (FIG. 4), including a processor as the central control feature, for suitably driving the fluorescent lamps, specifically the power delivery circuit, according to the present invention. Each LCD instrument display system 32 also receives a pilot command brightness switch input 34 representing a pilot selected modification relative to the overall instrument display brightness as established by the cockpit brightness signal 26, i.e., individual brightness modification for each display system 32.

FIG. 2 illustrates a power delivery circuit 60 of each system 32 responsible for suitably driving its fluorescent lamps 62 and 64 in response to a dimmer current control signal 66, a first dimmer frequency signal 68, and a second dimmer frequency signal 70. According to this embodiment of the invention, a selected quantum of energy is used to strike an arc in the fluorescent lamps 62 and 64. The selected quantum of energy is controlled as a function of a given magnitude of current being delivered into the power circuitry of the fluorescent lamp. Dimming is achieved by varying the rate at which the selected quanta of energy are sent to the lamps 62 and 64. A control processor 132 (FIG. 4) of each system 32 determines the frequency of trigger pulses provided in the signals 68 and 70, and produces the dimmer current control signal 66, an analog signal, which defines a suitable magnitude of energy delivered to prevent overdriving of the fluorescent lamps 62 and 64 at high luminance levels. The processor 132 and most of the elements shown in the top portion of FIG. 4 are available as a package in the Intel (TM) controller sold under Product No. 87C196. Signal 66 thereby accommodates dynamic impedance changes of the lamps 62 and 64 according to variation in the frequency of trigger pulses in signal 68 and 70.

With reference to FIGS. 3A–3C, the first dimmer frequency signal 68 repeats a one microsecond width trigger pulse at a selected frequency. The second dimmer frequency signal 70 presents a repeating six microsecond width pulse operated at the same frequency as signal 68. The leading edges of corresponding pulses in the signals 68 and 70 are coincident. The magnitude of dimmer current control signal 66 is coordinated with the frequency of signals 68 and 70 in order to suitably drive the lamps 62 and 64. As shown in FIG. 3C, the magnitude of dimmer current control signal 66 varies linearly between four volts and zero volts as the frequency of signals 68 and 70 varies between 60 Hz and 1 KHz. For frequencies above 1 KHz, the dimmer current control signal 66 remains flat. The trigger pulses 68*a* of the first dimmer frequency signal 68 each start a dimmer control loop. The pulses 70*a* of the second dimmer frequency signal 70 are used to override the dimmer control loop in the event of failure.

Returning to FIG. 2, the dimmer current control signal 66 is applied to a variable current threshold block 80. The block 80 also receives a reference signal 82 from a reference block 84. Block 80 thereby produces a threshold signal 86 selected as a function of signal 66. Each of the dimmer frequency signals 68 and 70 are applied to buffers 88 and 90, respectively, the dimmer frequency signal 68 appearing as an output of the buffer 88 and the dimmer frequency signal 70 appearing as an output of the buffer 90. The buffers 88 and 90 are provided as a safety or isolation feature and to reduce noise in the signals 68 and 70.

Each of the fluorescent lamps 62 and 64 include associated drive circuitry 100, individually 100*a* and 100*b*, including a bi-state flip-flop block 102, a current driver block 104, a current *comparitor 106, and a transformer 108. Each of the driver circuits 100 operates in identical fashion and receives in parallel the threshold signal 86, the dimmer frequency signal 68 as provided by buffer 88, and the dimmer frequency signal 70 as provided by buffer 90. The drive circuit 100*a* for the fluorescent lamp 62 will be discussed in further detail, and the description thereof applies equally to the drive circuit 100*b* for fluorescent lamp 64.

The leading edge of each pulse 68*a* of the dimmer frequency signal 68 enables the flip-flop block 102 which in turn initiates delivery of current by driver 104 into primary winding of the transformer 108. The comparitor 106 monitors the magnitude of current entering transformer 108 and, at a given transition point, disables the flip-flop block 102. The comparitor 106 uses the threshold signal 86 as delivered by the block 80 as a basis for determining the transition point. Once the magnitude of current entering the transformer 108 reaches the selected threshold value the flip-flop 102 is disabled, and this in turn disables driver 104. The inductive energy then stored in the primary windings of transformer 108 is delivered by way of the secondary windings to the anode of lamp 62 to cause the striking of an arc therein. The dimmer frequency signal 70 is a safety feature whereby, in the event of failure on the part of comparitor 106 to halt delivery of current into transformer 108, the trailing edge of dimmer frequency 70 disables the flip-flop block 102 to unconditionally halt delivery of current into transformer 108 at the end of a six microsecond period.

The current in the primary windings of the transformer 108 ramps up at a rate of: $Di/Dt = V/L$ where V is the applied supply voltage and L is the inductance of the transformer primary winding. The energy stored in the transformer 108 at the time driver 104 ceases current delivery is: $E = \frac{1}{2}LI^2$ where L is the inductance of the transformer primary and I is the current at the time the driver 104 is disabled. The power delivered to the lamp 62 is: $P = Ef$ where E is the energy stored in the transformer and f is the frequency of the energy pulses. The current magnitude thereby ramps to a predetermined value independent of supply voltage. In this manner, the system can handle an unstable voltage supply without undesirable effect relative to display brightness, i.e., consistent energy delivery to the backlight lamps.

FIG. 4 illustrates a dimmer control circuit 130 responsible for producing the dimmer frequency signals 68 and 70 and the dimmer current control signal 66 as a function of various input commands and sensor readings indicating ambient light conditions and lamp temperatures. In FIG. 4, a control processor 132 receives a variety of control inputs 134 by way of A/D converter 136 and has access to a lookup table 138 for producing suitable output signals as a function of the control inputs 134 received. Processor 132 receives the cockpit brightness signal 26 as a digital word by way of UART 144. The pilot command brightness signal 34 and day/night signal 28 are applied directly to the processor 132.

A/D converter 136 receives from ambient light sensors 146 an ambient light signal 148 representing current ambient light conditions at the bezel of the associated display system 32. In other words, each display system 32 includes a pair of ambient light sensors 146 in order to determine the ambient light present at the face of the LCD display. In this manner, each system 32 can respond to the particular lighting conditions present at its face. Additional light sensors 154 and 156 adjacent lamps 62 and 64, respectively, provide lamp luminance signals 158 and 160 corresponding to the current light energy output of fluorescent lamps 62 and 64, respectively. The lamp luminance signals 158 and 160 are applied to buffers 162 and 164, respectively. The lamp luminance signals 158 and 160 are then applied to the A/D converter 136 for delivery thereby to the processor 132 as components of the control inputs 134.

Temperature sensors 172 and 174 monitor the temperature of the cold shoe 176 for lamps 62 and 64, respectively, and produce corresponding lamp temperature signals 178 and 180. The lamp temperature signals 178 and 180 are applied to buffers 182 and 184. The temperature signals 178 and 180 are then applied to the A/D converter 136 for conversion into one of the control inputs 134 as delivered to the processor 132.

Lamp heaters 190 selectively apply heat to the fluorescent lamps 62 and 64 by actuation of a common lamp heater on signal 192. Each heater 190 is coupled at one end to a ground potential and at the other end to a switch 194. The switch 194 selectively couples a voltage potential 196 to the lamp heaters 190 in order to apply heat energy to the fluorescent lamps 62 and 64. The processor 132 provides the lamp heater on signal 192 in order to selectively heat the lamps 62 and 64 in accordance with operation under the present invention.

A thermo-electric cooler device 200 is applied to the cold shoe 176 of lamps 62 and 64. Thermo-electric cooler device 200 pumps heat from one surface to the other depending on the direction of current flow through cooler device 200, i.e., according to the "peltier" effect. Thus, the thermo-electric cooler device 200 may selectively cause absorption or liberation of heat energy relative to the cold shoe 176. In implementation of the thermo-electric cooler device 200, stacks of silicon and metal are used to form the junctions of the device. In operation, the thermo-electric cooler device 200 appears as a resistive device in the circuit. A DC current is provided in one direction to use the heating effects of the device 200, i.e., during cold start. A pulse width modulated 60 Hz signal providing DC current in the opposite direction is used for the cooling effects of device 200, the width modulation selected determining the magnitude of cooling effect achieved.

One side of the thermo-electric cooler device 200 is tied to a five volt potential 202. The other side of the thermo-electric cooler device 200 couples to both the switches 204 and 206. The switch 204 is responsive to a thermo-electric cooler heat signal 208 whereby a 13 volt potential may be selectively applied to the thermo-electric cooler in order to deliver heat energy into the cold shoe 176. The switch 206 responds to a thermo-electric cooler on signal 212 in order to selectively couple the thermo-electric cooler device 200 to a ground potential 214. By asserting neither of signals 208 and 212, the device 200 is disabled, i.e., provides neither heating nor cooling effects. As may be appreciated, the thermo-electric cooler heat signal 208 and thermo-electric cooler on signal 212 should not be actuated concurrently. As shown in FIG. 4, the control processor 132 is responsible for producing the thermo-electric heat signal 208, the thermo-electric cooler on signal 212 and the lamp heater on signal 192. A heat sink 216, e.g., the fluorescent lamp frame, is provided for suitable operation of the thermo-electric cooler 200.

Processor 132 provides in digital form the dimmer current control signal 66 to a D/A converter 220. The D/A converter 220 in turn provides the analog form of the dimmer current control signal 66 for application to the power delivery circuit 60 of FIG. 2. Processor 132 also delivers in digital form a frequency command 222 to a pulse generator 224. The pulse generator 224 in turn produces the dimmer frequency signals 68 and 70 at the selected frequency and with leading edges concurrent. Processor 132 further provides a disable pulse output signal 226 which is applied to the pulse generator 224. In this manner, the processor 132 selectively prevents generation of signals 68 and 70, and thereby selectively inhibits operation of the power delivery circuit 60 of FIG. 2.

Figure 5:
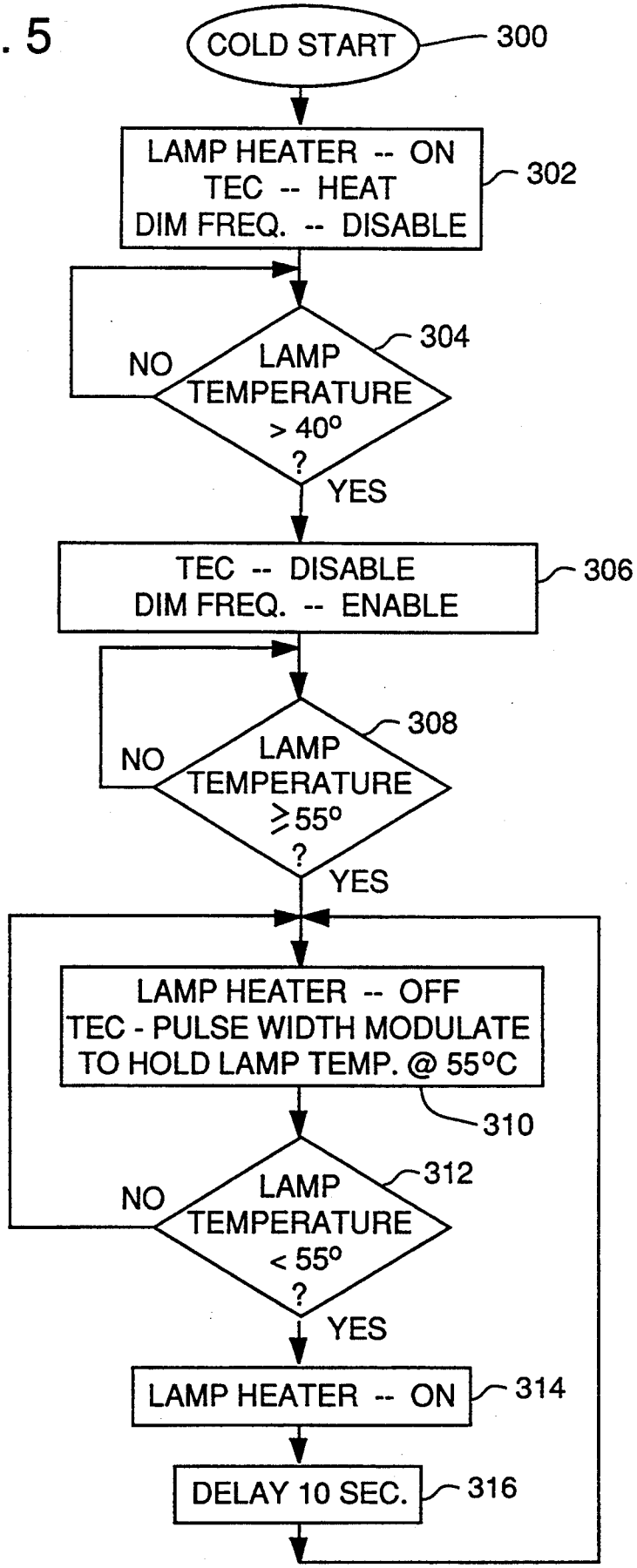
FIGS. 5 and 6 are flow charts illustrating operation of the fluorescent lamp dimmer control in accordance with the preferred form of the present invention.

FIG. 5 is a flow chart illustrating temperature responsive operation of the dimmer control circuitry according to programming of the control processor 132 and in accordance with the preferred embodiment of the present invention. The illustrated flow chart begins with a cold start and shows control processing during lamp operation including detection of current temperature related conditions in order to maintain a given display luminance while optimally driving the lamps 62 and 64.

Figure 6:
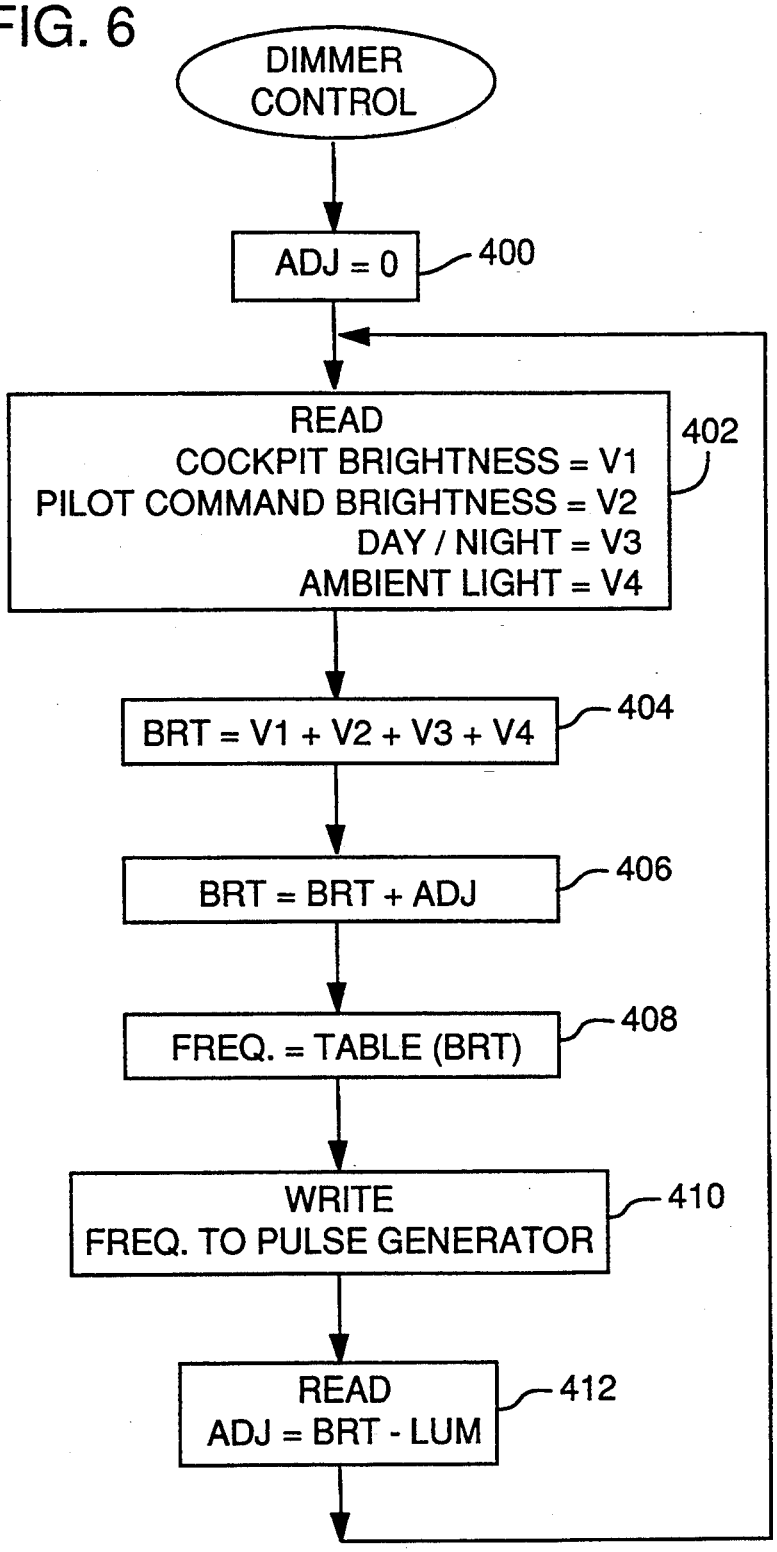

FIG. 6, discussed more fully below, illustrates programming of the processor 132 in response to other related conditions including ambient light conditions and dimmer control conditions to select an appropriate frequency for operation of the pulse generator 224.

The programming illustrated in FIGS. 5 and 6 executes substantially concurrently, i.e., by multi-tasking, whereby the resulting lamp luminance remains consistent according to operator selected control functions, dynamic temperature conditions, and dynamic light conditions including both ambient light conditions and light conditions taken directly at the lamps 62 and 64.

In FIG. 5, beginning with a cold start condition 300, processor 132 in the block 302 executes procedures to turn on the lamp heaters 190 by way of the lamp heater on signal 192, put into heating mode the thermo-electric cooler device 200 by way of thermo-electric cooler heat signal 208, and disable the dimmer frequency signals 68 and 70 by use of the disable pulse out signal 226. Continuing to decision block 304, processor 132 utilizes the lamp temperature signals 178 and 180 to determine whether lamps 68 and 64 have exceeded 40 degrees centigrade. Processing loops at the decision block 304 until lamps 62 and 64 have exceeded a temperature of 40 degrees centigrade. Once lamps 62 and 64 have exceeded 40 degrees centigrade, processor 132 in block 306 disables the thermo-electric cooler device 200 by de-asserting signals 208 and 212. As discussed hereafter, processor 132 concurrently enables the dimmer frequency signals 68 and 70 by way of signal 226, and provides a frequency command 222 to the pulse generator 224 to operate at a frequency corresponding to a desired brightness.

Continuing from processing block 306, the processor 132 enters the decision block 308 where the lamp temperature signals 178 and 180 are monitored and compared to a given optimum operating temperature. In the illustrated embodiment, the optimum operating temperature is 55 degrees centigrade. Processing loops at the decision block 308 until the temperature of lamps 62 and 64 is equal to or greater than 55 degrees centigrade. Upon such condition, processing branches to block 310 where the processor 132 turns off the lamp heaters 190, applies a pulse width modulated thermo-electric cooler on signal 212, i.e., puts device 200 into a cooling mode, to hold the lamp temperature down to approximately 55 degrees centigrade. Continuing to decision block 312, processing loops back from block 312 to block 310 until the lamp temperature drops below 55 degrees centigrade. Upon such condition, processing continues to block 314 where the lamp heaters 190 are again activated. Continuing to block 316, processor 132 delays for a 10 second interval and then returns to the block 310. Thus, the operation of processor 132 in looping between blocks 312 and 310 represents the normal operating condition of the display system 32. The lamp temperature is maintained substantially at 55 degrees centigrade. The other loop of FIG. 5, wherein processor 132 executes the blocks 310, 312, 314, and 316, represents a cold lamp condition which is corrected by activating the lamp heaters for a given interval and returning to test the lamp temperature in block 312.

The brightness of an individual instrument display system 32 is a function of the selected frequency at which the signals 68 and 70 operate. This frequency value is taken from the lookup table 138 by processor 132. The pointer into the lookup table 138 is an expression of desired brightness developed as a function of the cockpit brightness signal 26, the pilot command brightness signal 34, the day/night signal 28, the ambient light signal 148, and the lamp luminance signals 158 and 160. More particularly, the cockpit brightness signal 26 establishes an overall brightness level for the aircraft instrument display panel generally, i.e., all systems 32. The day/night signal 28 offsets this overall brightness level in response to pilot operation of, for example, a day/night rocker switch. The pilot command brightness signal 34 increases or decreases an individual display system 32 relative to the overall brightness level established by the signals 26 and 28. Finally, the selected frequency for a given display system 32 must take into account the ambient light conditions, i.e., signal 148, and sensor data representing actual lamp output for the particular instrument display 32.

FIG. 6 illustrates the programming applied to the processor 132 in implementing these control functions. In FIG. 6, dimmer control begins by first setting an adjustment variable ADJ to zero in block 400. Processor 132 reads, in block 402, values for the cockpit brightness signal 26, pilot command brightness signal 34, the day/night signal 28, and the ambient light signal 148 and applies these values, as appropriately converted to compatibly express brightness, to the variables V1, V2, V3, and V4, respectively. The value for ambient signal 148, for example, is with reference to a given standard ambient light level and can be a positive or negative value.

In block 404, processor 132 sums variables V1, V2, V3, and V4 and assigns this value to the lookup table index pointer BRT. In block 406 processor 132 sums the values held in variables BRT and ADJ and assigns this value back to the variable BRT. Lookup table 138 is then accessed in block 408 using the variable BRT as an index pointer to obtain a frequency value held in the variable FREQ. Continuing to block 410, the variable FREQ is then written to pulse generator 224 and the lamps operate at a given brightness magnitude as a function of the selected frequency.

In block 412, processor 132 reads the lamp luminance signals 158 and 160. This data is then converted appropriately and stored in the variable LUM for compatibility with brightness as expressed by the index pointer BRT. The value of LUM is then subtracted from the value of BRT and stored in the variable ADJ to reflect a difference between expected brightness and actual brightness of the lamps 62 and 64. Processing then returns to block 402 where the signal 26, 34, 28, and 148 are again accessed and assigned to the variables V1, V2, V3, and V4, respectively. The index pointer, as processing continues through to block 406, is adjusted according to the value of ADJ to reflect a necessary adjustment in brightness to account for the actual or detected lumens of lamp 62 and 64. Processing continues looping through the blocks 402–412 during normal operation of the system.

Thus, the pilot sets a desired brightness for instrument displays, including control over individual instrument systems 32. Through the mission, the brightness of each display is automatically compensated according to varying ambient lighting conditions and changing temperature conditions within the individual displays. Also, as may be appreciated, as the lamps may deteriorate over time but the output is maintained constant by virtue of the monitoring of actual lamp output and feedback adjustment according to such output. In this manner, the pilot commanded brightness is maintained relative to all such dynamic conditions. The pilot enjoys full control over display brightness and enjoys a consistent display brightness despite changes in ambient light conditions, and variation in lamp operation due to temperature changes or deterioration in output capability over time.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

The embodiments of the invention in which an exclusive property or right is claimed are defined as follows:

1. A dimmer control arrangement for an aircraft display including a liquid crystal display and associated fluorescent lamp backlight, the control arrangement comprising:

sensors monitoring conditions of said fluorescent lamp effecting perceived luminance of said display, said sensors providing corresponding sensor outputs;

an energy delivery mechanism delivering a selected magnitude of energy to said lamp at a selected frequency;

a memory means containing a plurality of frequencies, each frequency of said plurality of frequencies is retrievable as a function of said sensor outputs; and a processor element receiving said sensor outputs and programmed to access said memory means and provide to said energy delivery system a representation of said selected frequency whereby said energy delivery system delivers said selected magnitude of energy at said selected frequency.

2. The control arrangement according to claim 1 wherein said energy delivery system responds to a trigger signal providing trigger pulses at said selected frequency whereby said given magnitude of energy is delivered to said lamp for each trigger pulse.

3. The control arrangement according to claim 2 wherein said given magnitude of energy is delivered by delivering a given current flow into a transformer driving said fluorescent lamp until said current flow reaches a given current magnitude.

4. The control arrangement according to claim 1 wherein said sensors monitor at least one of ambient light, lamp temperature, and lamp light energy output.

5. The control arrangement according to claim 1 wherein said plurality frequencies are selected so that varying energy delivery to said lamp appears as a linear change in luminance to a viewer of the liquid crystal display.

6. The control arrangement according to claim 5 wherein the memory means is a look-up table.

* * * * *